US006398675B1

(12) United States Patent
Eggiman et al.

(10) Patent No.: US 6,398,675 B1
(45) Date of Patent: Jun. 4, 2002

(54) BAT WITH ELASTOMERIC INTERFACE

(75) Inventors: Michael D. Eggiman, Hillsboro; Mark A. Fritzke, Portland, both of OR (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 09/610,340

(22) Filed: Jul. 3, 2000

(51) Int. Cl.[7] ..... A63B 59/06
(52) U.S. Cl. ..... 473/566; 473/520
(58) Field of Search ..... 473/457, 564–568, 473/519, 520

(56) References Cited

U.S. PATENT DOCUMENTS

| | | | |
|---|---|---|---|
| 3,727,295 | A | 4/1973 | Gildemeister |
| 3,801,098 | A | 4/1974 | Gildemeister |
| 3,861,682 | A | 1/1975 | Fujii |
| 3,876,204 | A | 4/1975 | Moore et al. |
| 3,963,239 | A | 6/1976 | Fujii |
| 3,972,528 | A | 8/1976 | McCracken et al. |
| 4,056,267 | A | 11/1977 | Krieger |
| 4,569,521 | A | 2/1986 | Mueller |
| 4,600,193 | A | 7/1986 | Merritt |
| 4,951,948 | A | 8/1990 | Peng |
| 5,104,123 | A | 4/1992 | Okitsu et al. |
| 5,364,095 | A | 11/1994 | Easton et al. |
| 5,415,398 | A | 5/1995 | Eggiman |
| 5,458,330 | A | 10/1995 | Baum |
| 5,511,777 | A | 4/1996 | McNeely |
| 5,722,908 | A | 3/1998 | Feeney et al. |

FOREIGN PATENT DOCUMENTS

| | | |
|---|---|---|
| JP | 51-13165 | 8/1976 |
| JP | 4-303477 | 10/1992 |
| JP | 523407 | 2/1993 |

*Primary Examiner*—Mark S. Graham
(74) *Attorney, Agent, or Firm*—Klarquist Sparkman, LLP

(57) ABSTRACT

A bat having an elongated impact portion includes a first tubular metal member and a second tubular member substantially concentric with the first tubular member. The first and second tubular members have adjacent facing cylindrical surfaces throughout a majority of the length of the impact portion which are slightly spaced apart from each other, and an elastomeric material is interposed between the facing cylindrical surfaces.

27 Claims, 2 Drawing Sheets

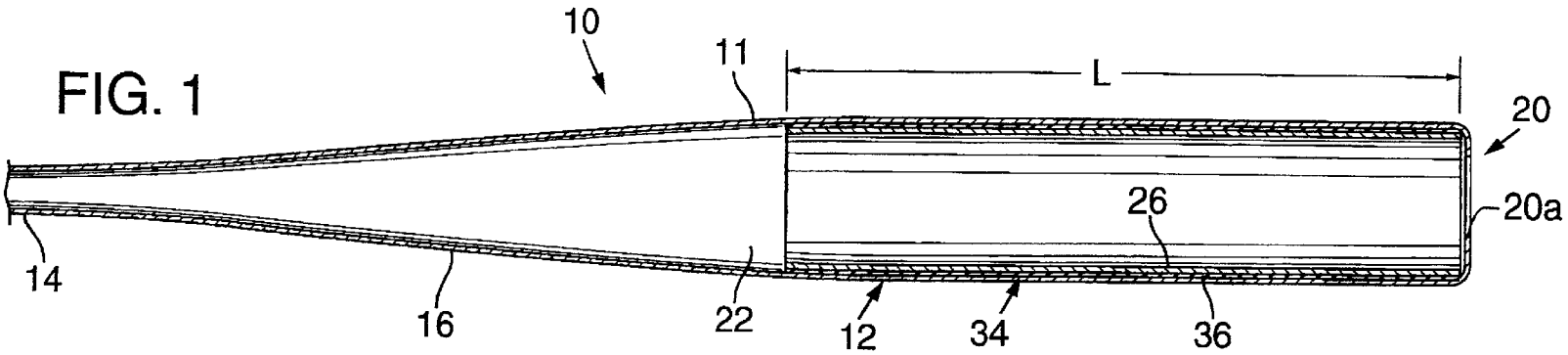
FIG. 1
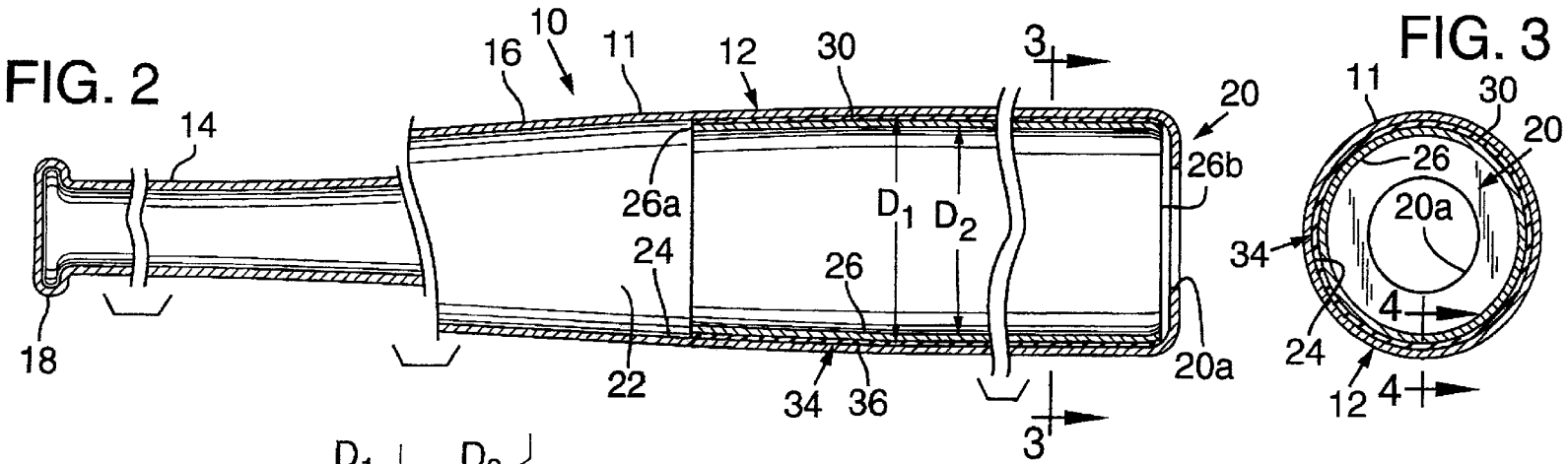
FIG. 2
FIG. 3
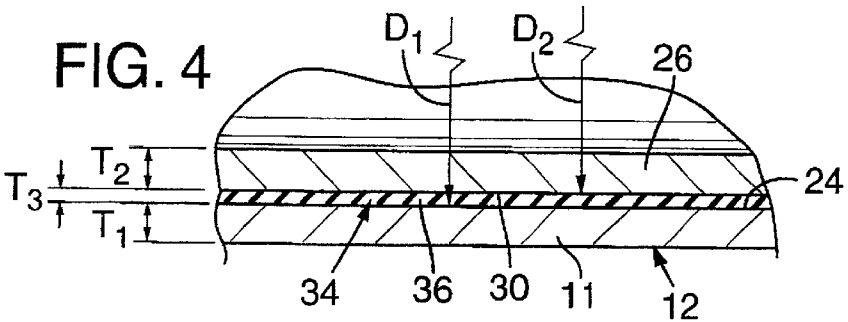
FIG. 4

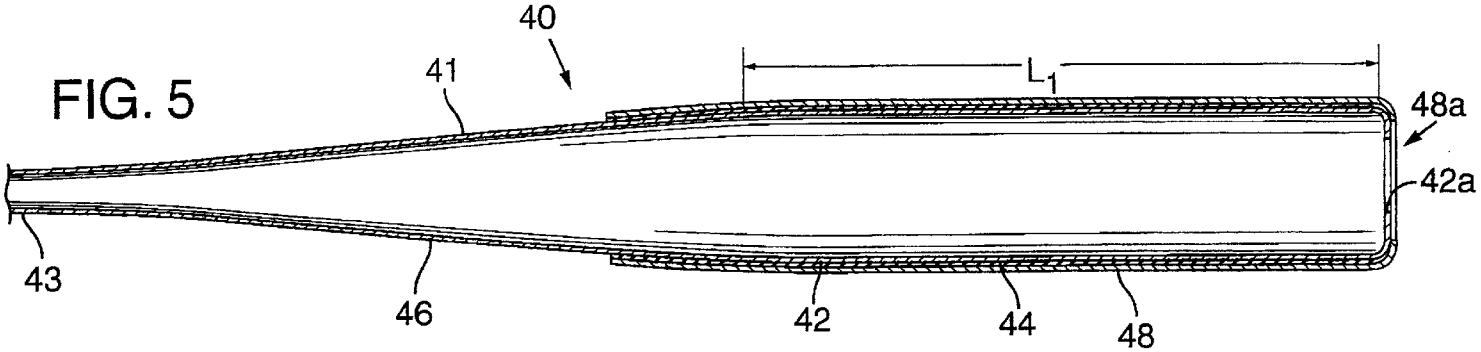
FIG. 5
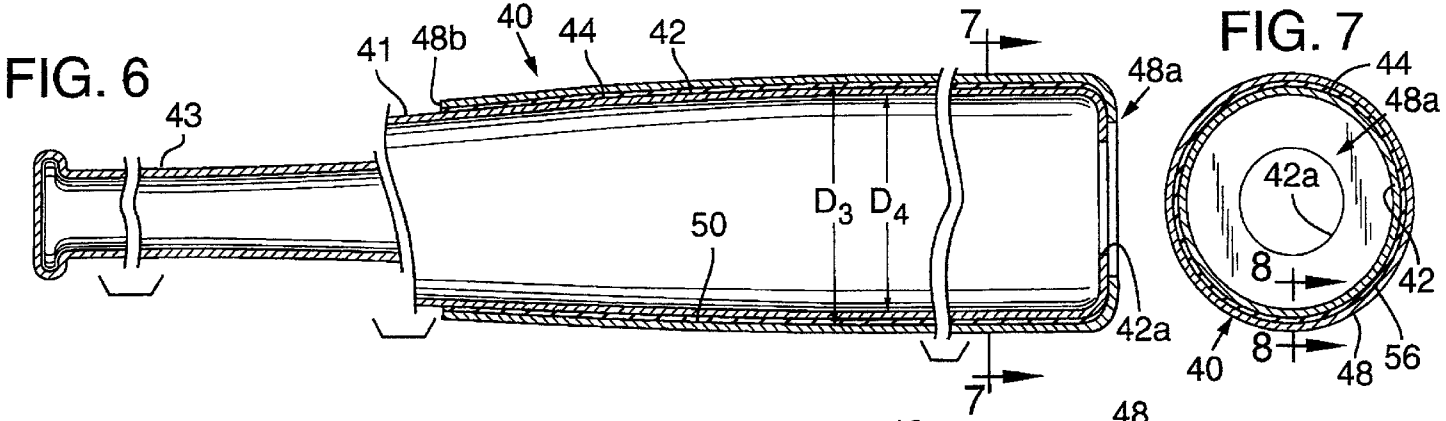
FIG. 6
FIG. 7
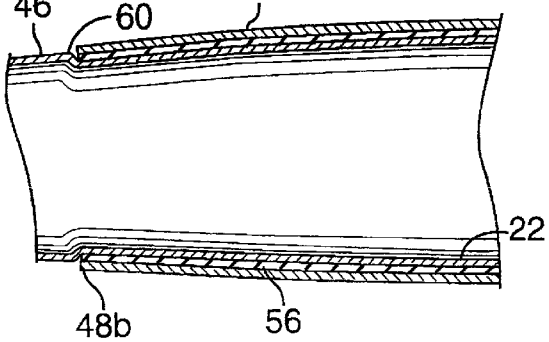
FIG. 9
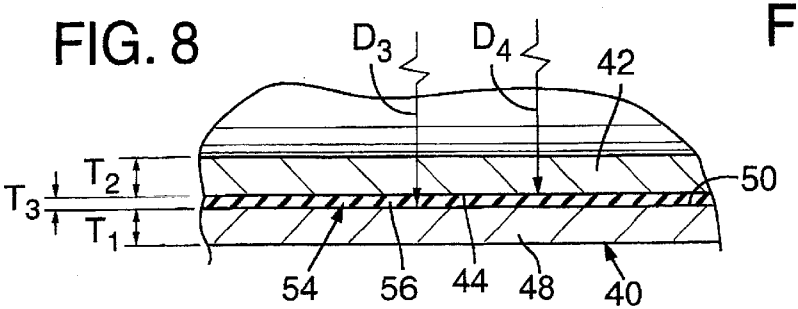
FIG. 8

BAT WITH ELASTOMERIC INTERFACE

FIELD OF INVENTION

This invention relates to a ball bat, and more particularly to a bat with inner and outer tubular members with an elastomeric interface therebetween, and a method for manufacturing such.

BACKGROUND AND SUMMARY OF THE INVENTION

Tubular metallic softball and baseball bats are well known in the art. A familiar example is a tubular aluminum bat. Such bats have the advantage of a generally good impact response, meaning that the bat effectively transfers power to a batted ball. This effective power transfer results in ball players achieving good distances with batted balls. An additional advantage is improved durability over crack-prone wooden bats.

Even though present aluminum bats perform well, there is a continuing quest for bats with better hitting capability. Accordingly, one important need is to optimize the impact response of a bat. Further, it is important to provide a bat with proper weighting so that its swing weight is apportioned to provide an appropriate center of gravity and swing speed and impact components during use.

Further, constraining the design of aluminum bats is the requirement that the elastic deflection not be accompanied by any plastic deformation. Plastic deflection lessens the power transferred to a ball and leaves the bat permanently dented. Thus, it is desirable to be able to provide a reinforcement for the impact region of the bat, which otherwise may be so thin as to be plastically deformed during hitting. But on the other hand, the tubular wall must not be so thick that it is too stiff to elastically deflect appreciably.

In light of the shortcomings of the prior art, it is an object of the present invention to provide an improved bat.

It is another object of the invention to provide a simple construction for a tubular bat with inner and outer tubular members.

In accordance with an embodiment of the present invention, a bat having an elongate impact portion is formed with a first tubular member and a second tubular member substantially concentric with the first tubular member. The first and second tubular members have facing cylindrical surfaces throughout a majority of the length of the impact portion and elastomeric material is interposed between the facing cylindrical surfaces.

Further, in accordance with an embodiment of the present invention, an elongate tubular metal member has a circular-striking portion, with the striking portion having an interior surface defining an interior cavity. An elongate tubular metal insert is located within the interior cavity and has an exterior surface complementary to and throughout a majority of its length slightly smaller than the interior of the striking portion. An elastomeric material is interposed between the interior surface and the exterior surface to permit some relative movement between the insert and the surrounding tubular member when a ball is batted.

Another object of the present invention is to provide a method for producing an improved bat.

BRIEF DESCRIPTION OF THE DRAWINGS

FIG. 1 is a sectional view through the longitudinal center of a bat in accordance with one embodiment of the invention.

FIG. 2 is a magnified sectional view of the bat of FIG. 1 with portions broken away.

FIG. 3 is a cross-sectional view taken generally along the line 3—3 of FIG. 2.

FIG. 4 is an enlarged view taken generally along the line 4—4.

FIG. 5 is a cross-sectional view through the longitudinal center of bat in accordance with a second embodiment of the invention.

FIG. 6 is a magnified sectional view of the bat of FIG. 5 with portions broken away.

FIG. 7 is cross-sectioned view taken generally along the line 7—7 in FIG. 6.

FIG. 8 is an enlarged view taken generally along the line 8—8 in FIG. 7.

FIG. 9 is a partial sectional view similar to FIG. 6, of a third embodiment.

DETAILED DESCRIPTION

Referring to FIG. 1, tubular ball bat 10 comprises an elongate tubular metal member 11 having a ball striking, or impact portion, 12, handle portion 14, and a tapered transition portion 16 that extends between the handle portion 14 and striking portion 12. As shown here, the impact, or ball striking, portion 12 has an elongate cylindrical shape. The impact portion 12 has a larger diameter that the handle portion 14. The transition portion 16 joins the impact portion 12 and handle portion 14 and accordingly tapers in diameter from one end to the other. A knob 18 is provided at one end of the handle portion.

The distal end 20 of the impact portion 12 is initially open to facilitate manufacture of the bat. However, at the end of the forming process, the distal end portion is formed over as illustrated in FIGS. 1–3 to partially enclose the distal end of the bat. A circular opening 20*a* is provided which will be closed by a plug (not shown).

The tubular metal member 11 forms the exterior of the ball bat and has a hollow interior, or interior cavity, 22 that extends the entire length of the bat. The striking, or impact, portion 12 has an interior surface 24 defining a portion of the interior cavity extending through the impact portion.

To provide improved hitting with the bat, an elongate tubular insert 26 is disposed within cavity 22 in impact portion 12.

The impact portion 12 has a defined length indicated generally at L. The interior surface 24 has a substantially cylindrical cross-section having a diameter indicated generally at $D_1$. Normally diameter $D_1$ would be in a range of from 2 to 2.75 inches.

The insert 26 has an outer wall, or exterior, surface 30 complementary to the shape of interior surface 24, but of a slightly smaller diameter $D_2$. Insert 26 has a length, which is a majority of the length L of the impact portion, and is shown in the illustrations as substantially equal to length L. Normally length L would be in a range of from 12 to 16 inches.

Referring to FIG. 4, the thickness of the metal material forming the impact portion 12 of the tubular metal bat member is indicated generally at $T_1$, while the thickness of the material forming insert 26 is noted at $T_2$.

Referring still to FIG. 4, a layer of elastomeric material 36 is interposed and fills the space between adjacent facing portions of the interior surface 24 of impact portion 12 and the exterior surface 30 of insert 26.

A first end 26*a* of the tubular insert, or sleeve, 26 is inserted within the impact portion to be forcefully lodged in abutment with the diametrically narrowing interior wall of the tapering portion 16, which inhibits movement of the insert in the direction toward the handle of the bat. A second, or distal, end 26*b* of the tubular insert, or sleeve, 26 is adjacent distal end 20 of the bat. The outermost, or topmost, portion of the impact portion of the bat indicated at 20 is curled inwardly over end 26*b* to produce a reduced-diameter head, or stop, portion for the bat which inhibits movement of insert 26 in the direction of the curled over end of the bat.

The interior surface 24 of the impact portion 12 is substantially continuously cylindrical, and the exterior surface 30 of the insert is substantially continuously cylindrical having a shape which is generally complementary to, and of a slightly small diameter than the interior surface of the tubular outer member throughout the majority of the length of the insert. It has been found to be desirable to provide a gap, or space, 34 between member 11 and insert 26. Space 34 in a preferred embodiment of the invention may have a width, or thickness, $T_3$ in a range of 0.002 to 0.012 inch. This width, or thickness, is important. If it is too small there will be insufficient space for an effective layer of elastomeric material as discussed below. On the other hand, of the space is too large insufficient energy transfer may occur between member 11 and insert 26.

The elastomeric material 36 between interior surface 24 and exterior surface 30 is interposed in the entire space between substantially all adjacent facing portions of these two surfaces of the tubular metal bat member and the insert. The elastomeric material may be any suitable material which is capable of transmitting at least a portion of the ball striking and rebound energy between the tubular bat member and the insert with a degree of deformation occurring in the elastomeric material generally radially of the bat. Further, the elastomeric material must be capable of withstanding shear forces imposed thereon due to shifting of surface portions of the tubular bat member and insert relative to each other longitudinally and/or circumferentially of the bat on hitting. The elastomeric material should be capable of fully recovering its size and shape after such deformation.

Examples of materials that may be used are a polymer or urethane material. It is preferable that the elastomeric materials have selected physical and operational characteristics.

The hardness and resilience of the elastomeric material will be chosen in relation to the width $T_3$ of the gap 34 between surfaces 24 and 30. It has been found that where the gap is about 0.01 inch the elastomeric material works well by having a durometer hardness rating of 80 Shore A hardness rating and resiliency of 45% per ASTM standard D2632-96. For narrower gaps a softer material may be used, and conversely, for a wider gap a harder material will be required to produce appropriate batting characteristics. For example, the durometer hardness rating may range from 20 to 120 Shore A and the resiliency from 30% to 70% per ASTM standard D2632-96. The elastomeric material also preferably has an adhesive characteristic so that it will adhere to and remain in place between the tubular members.

The narrow gap, or space, 34 between the tubular outer member and the insert provides sufficient space for a desired amount of elastomeric material, yet does not provide sufficient space for plastic deformation to occur in the tubular outer member upon impact, or striking, forces occurring. The elastomeric material between the two members is adequate to permit a slight amount of elastic deformation of the outer tubular member, yet transmits striking force inwardly toward the insert, such that the insert provides added support and rebound energy during the striking operation.

In one embodiment, both the tubular outer member, or frame, and the insert are made of aluminum. The outer bat portion is formed by swaging from an aluminum tube to yield an integral weld free frame having the impact portion, handle, and transition portion as previously described. While swaging has been noted as a means of producing the outer member, it should be understood that other methods of manufacturing might work equally as well. As noted, the outer member is formed with a circular cross-section having a striking portion which has a cylindrical interior surface defining an interior cavity of selected first cross-sectional dimension $D_1$ when at a normal ambient temperature.

The insert 26 may be formed of a tubular metal material, which may be aluminum, steel, titanium, or other suitable metal material. The insert also may be formed of other materials, such as carbon fiber. The insert is formed into a shape having a cylindrical exterior surface complementary in shape to the interior surface. The insert has a second outer cross-sectional dimension $D_2$ at normal ambient temperature, which is slightly less than the first interior dimension $D_1$ of the striking portion. The thickness of the material of the impact portion 12 denoted generally at $T_1$ is in a range of 0.04 to 0.08 inches, while the thickness of insert 26 denoted generally at $T_2$ is in a range of 0.04 to 0.08 inches.

The outer diameter of the insert is such that at normal ambient temperature it is slightly less than the interior diameter of the outer member at ambient temperature. The diameter of the interior surface of impact portion 12 at normal ambient temperature is denoted generally at $D_1$ and the exterior surface diameter $D_2$ of the insert when initially formed at normal ambient temperatures could be in a range of ($D_1$–0.004) inch to ($D_1$–0.024) inch to provide a space $T_3$ between the two when assembled in a range of 0.002 to 0.012 inch.

In initial forming, the distal end 20 of the outer tubular member 12 would not have been curled in as shown. Instead it would be formed to produce a full open cavity mouth into which insert 26 may be inserted.

Prior to assembly either the external surface of the insert 26 or the interior surface 24 of the impact area 12 are coated with an appropriate elastomeric material as discussed above to a thickness at least as great as dimension $T_3$. This material may be applied to the insert by spraying, rolling, or hand application, or to the interior surface of the impact portion.

The impact portion 12 of the outer member may be heated to a temperature sufficiently above ambient normal temperature to cause the interior cavity to expand. Conversely, the insert could be cooled below ambient temperature to cause it to shrink. In other words, a temperature differential may be produced between the outer member and the insert so that the insert may be slid easily into the outer member, with the layer of elastomeric material therebetween. While the temperature differential exists between the parts the insert is moved into the internal cavity to the position shown in FIGS. 1, 2 and 3. The bat parts then are allowed to return to ambient temperature to produce a close fit with the elastomeric material therebetween.

Referring to FIGS. 5–8, a second embodiment of the bat of the invention is illustrated. A ball bat 40 comprises an elongate tubular metal member 41 having a ball striking, or impact, portion 42, handle portion 43 and transition-tapered portion 46. The striking, or impact, portion 42 has an exterior surface 44.

To provide improved hitting with the bat, an elongate tubular member, in the form of sleeve 48 is disposed about portion 42 of the tubular member 41. The bat thus has an elongate impact portion with a defined length indicated generally at L formed by a combination of portion 42 of tubular member 41 and tubular member, or sleeve, 48. These bat parts are substantially concentric and have facing cylindrical surfaces throughout a major portion of the length of the impact portion L. Generally the thicknesses of the tubular members would be similar to that previously discussed in relation to the embodiment illustrated in FIGS. 1–4 and a similar fit would be provided therebetween.

As is best seen in FIGS. 5 and 6 the distal end of portion 42 is curled inwardly to form a rounded outer end 42*a*, and the distal end 48*a* of the sleeve also is curled inwardly over the outer end of section 42*a*. Sleeve 48 is slightly longer than impact portion L the tubular member 41 and the portion adjacent end 48*b* is formed inwardly to follow the general taper of tapered section 46 of tubular member 41. This generally secures the sleeve 48 against shifting inwardly or outwardly longitudinally of member 41.

Referring to FIGS. 7 and 8, a layer of elastomeric material 56 is interposed between the exterior surface 44 of the impact portion 12 and the interior surface 50 of sleeve 48.

The interior surface 50 of sleeve 48 is substantially continuously cylindrical. The exterior surface 44 of portion 42 is substantially continuously cylindrical also, having a shape which is complementary to the interior surface of the sleeve throughout a majority of the length of the impact portion L. Here again, it has been found desirable to provide a space, or gap, 54 between the members, in a range of 0.002 to 0.012 inch.

Elastomeric material 56 is interposed between substantially all adjacent parts of these two surfaces and may be of materials similar to and applied similarly as described above. The materials used for the tubular portions also may be similar to those described above with similar thicknesses and other sizes.

In the embodiment illustrated in FIGS. 5–8, the inner diameter of sleeve 48 is indicated generally at $D_3$ when initially formed at normal ambient temperature. The exterior surface diameter $D_4$ of tubular portion 42 when initially formed at normal ambient temperature could be in a range of ($D_3$–0.004) inch to ($D_3$–0.024) inch.

Prior to assembly either the external surface of tubular portion 42 or the interior surface of sleeve 48 is coated with an appropriate elastomeric material 56. Such may be of materials and applied as set out for the previously described embodiment. Either the sleeve 48 is heated above ambient temperature or the tubular metal impact portion 42 is cooled sufficiently below ambient temperature, such that a temperature differential exists between the parts to allow the sleeve to be slid over the tubular bat frame 42 to the position illustrated in FIGS. 5–8. After the parts thus have been assembled they are allowed to return to ambient temperature which produces a close fit with elastomeric material interposed therebetween.

FIG. 9 is a partial sectional view similar to a portion of FIG. 6 of a third embodiment. Here tapered portion 46 has an annular ridge 60 formed thereon of a height substantially equal to the thickness of sleeve 48. The inner end 48*b* of sleeve 48 rests against the ridge, thus to provide a substantially continuous surface configuration for the tapered portion 46 and sleeve 48, while maintaining the general structural and functional characteristics of the bat thus described.

In view of the many possible embodiments to which the principals of the present invention may be put, it should be recognized that the detailed embodiments set out herein are illustrative only and should not be taken as limiting the scope of the invention. I claim as my invention all embodiments as may come within the scope and spirit of the following claims and equivalents thereto.

We claim:

1. A bat comprising:

an elongate tubular metal member having a circular cross-section with a striking portion of a defined length, said striking portion of the member having an interior surface defining an interior cavity, an elongate tubular insert located within said interior cavity, said insert having a length which is a majority of said defined length, and an exterior surface complementary to and throughout a majority of its length spaced radially inwardly from said interior surface a distance in a range of 0.002 to 0.012 inch, elastomeric material interposed between and substantially filling the space between said interior surface and said exterior surface, said elastomeric material having a durometer hardness in a range of between 20 and 120 Shore A and a resiliency in a range between 30% and 70%, and the interior of said striking portion of the member has a reduced internal diameter at one end thereof against which one end portion of the insert bears to inhibit movement of said insert in the direction of said one end.

2. The bat of claim 1, wherein the length of said insert is at least equal to said defined length.

3. The bat of claim 1, wherein said interior surface is substantially continuously cylindrical and the exterior surface is substantially continuously cylindrical.

4. The bat of claim 1, wherein said elastomeric material comprises polyurethane.

5. The bat of claim 1, wherein said elastomeric material has a durometer hardness of about 80 Shore A.

6. The bat of claim 1, wherein said elastomeric material has a resiliency of about 45%.

7. The bat of claim 1, wherein said elastomeric material is adhesive.

8. The bat of claim 1, wherein a stop is positioned adjacent a second end of said striking portion against which a second end of said insert opposite said one end bears to inhibit movement of said insert in the direction of said second end.

9. The bat of claim 1, wherein the striking portion of said member has a wall thickness in a range of 0.04 to 0.08 inch.

10. The bat of claim 1, wherein said insert has a wall thickness in a range of 0.04 to 0.08 inch.

11. A bat comprising:

an elongate tubular metal member having a striking portion of a first diameter, handle portion of a second lesser diameter, and tapered portion extending therebetween, the tubular member having an inner bore wall which defines an internal cavity;

an elongate tubular sleeve located within the cavity and extending substantially the length of the striking portion, the sleeve having an outer wall complementary to and throughout a major portion of its length spaced radially inwardly from the inner bore wall of the striking portion a distance in a range of 0.002 to 0.012 inch, with one end engaging said tapered portion to inhibit movement of the sleeve in the direction of said tapered portion, and elastomeric material interposed between the member and sleeve and substantially filling the space between the inner bore wall and the outer wall, said elastomeric material is adhesive, has a durometer hardness in a range of between 20 and 120 Shore A, and a resiliency in a range between 30% and 70%.

12. The bat of claim 11, wherein said elastomeric material fills the space between all adjacent facing portions of the inner bore wall and the outer wall.

13. The bat of claim 11, wherein said elastomeric material has a durometer hardness of about 80 Shore A.

14. The bat of claim 11, wherein said elastomeric material has a resiliency of about 45%.

15. A bat having an elongate impact portion comprising:

a first tubular member, a second tubular member substantially concentric with the first tubular member, said first and second tubular members having facing cylindrical surfaces throughout the majority of the length of the impact portion with a space therebetween in a range of 0.002 to 0.012 inch; and elastomeric material is interposed in and fills the space between all adjacent facing cylindrical surfaces of the first tubular member and second tubular member, said elastomeric material being polyurethane having a durometer hardness in a range of between 20 and 120 Shore A and a resiliency in a range between 30% and 70%.

16. The bat of claim 15, wherein said elastomeric material has a durometer hardness of about 80 Shore A.

17. The bat of claim 15, wherein said elastomeric material has a resiliency of about 45%.

18. The bat of claim 15, wherein said first tubular member has a striking portion of a first diameter, and a handle portion of a second lesser diameter, the striking portion having an inner bore wall which defines an internal cavity;

and said second tubular member comprises an elongate insert located within the cavity and extending substantially the length or the striking portion, the insert having an outer wall complementary to and throughout a major portion of its length spaced a selected distance radially inwardly from the inner bore wall of the striking portion.

19. The bat of claim 15, wherein said first tubular member has a striking portion of a first outer diameter and a handle portion of a second lesser diameter, and said second tubular member comprises a sleeve located about the striking portion of the first tubular member and extending substantially the length of the striking portion, the sleeve having an internal wall complementary to and throughout the major portion of the length spaced a selected distance radially outwardly from the outer diameter of the striking portion.

20. A method for constructing a bat comprising the steps of forming an elongate tubular metal member having a circular cross-section with a striking portion, said portion having a cylindrical interior surface defining an interior cavity of selected first cross-sectional dimension, forming an elongate tubular insert having a cylindrical exterior surface complementary in shape to said interior surface and having a second cross-sectional dimension which is in a range of 0.004 to 0.024 inch less than said first dimension, placing the insert in said striking portion with a space therebetween, filling the space between said interior and exterior surfaces with elastomeric material, said elastormeric material having a durometer hardness in a range of between 20 and 120 Shore A and a resiliency in a range between 30% and 70%, and providing a stop on said member adjacent one end thereof against which said insert will bear to inhibit longitudinal movement of said insert in the direction of the stop.

21. The method of claim 20, wherein said insert is formed with a length which is a majority of the length of the striking portion of said tubular member.

22. The method of claim 20, wherein said elastomeric material comprises polyurethane.

23. The method of claim 20, wherein said elastomeric material has a durometer hardness of about 80 Shore A.

24. The method of claim 20, wherein said elastomeric material has resiliency of about 45%.

25. The method of claim 20, wherein said elastomeric material is applied to said interior surface before placing the insert in said striking portion.

26. The method of claim 20, wherein said elastomeric material is applied to said exterior surface before placing the insert in said striking portion.

27. A bat comprising:

an elongate tubular metal member having a circular cross-section with a striking portion of a defined length, said striking portion of the member having a cylindrical interior surface defining an interior cavity of a first cross-sectional dimension, an elongate tubular insert located within said interior cavity, said insert having a cylindrical exterior surface complementary in shape to said interior surface and throughout a majority of its length having a second cross-sectional dimension which is in a range of 0.004 to 0.024 inch less than said first dimension, and elastomeric material interposed between and substantially filling the space between said interior surface and said exterior surface, said elastomeric material having a durometer hardness in a range of between 20 and 120 Shore A and a resiliency in a range between 30% and 70%.

* * * * *